US005518074A

United States Patent [19]

Brotherson

[11] Patent Number: 5,518,074

[45] Date of Patent: May 21, 1996

[54] TRANSPORTABLE FIRE EXTINGUISHING SYSTEM

[75] Inventor: Gaylen M. Brotherson, Scottsdale, Ariz.

[73] Assignee: 1st Defense Industries, Scottsdale, Ariz.

[21] Appl. No.: 303,188

[22] Filed: Sep. 8, 1994

[51] Int. Cl.[6] ..... A62C 8/06

[52] U.S. Cl. ..... 169/50; 206/494

[58] Field of Search ..... 169/49, 50, 51; 221/45, 50, 63, 64; 206/494, 804, 812; 383/66

[56] References Cited

U.S. PATENT DOCUMENTS

| | | | |
|---|---|---|---|
| 3,828,856 | 8/1974 | Wallis | 169/50 |
| 4,597,450 | 7/1986 | Budmiger | 169/50 |
| 4,624,320 | 11/1986 | Romaine | 169/50 |
| 5,083,617 | 1/1992 | Pierce, Jr. | 169/50 |

*Primary Examiner*—Andrew C. Pike

*Attorney, Agent, or Firm*—Zarley, McKee, Thomte, Voorhees & Sease; Mark D. Frederiksen

[57] ABSTRACT

A fire extinguishing system includes a cloth treated with fire retardant material folded and inserted within a lightweight rectangular plastic bag having adhesive strips on a rearward wall for attachment of the bag to a predetermined location. The cloth is folded such that one corner projects through an aperture in a forward wall of the bag to permit the cloth to be pulled from the bag. Perforation lines extending from the aperture towards the lower corners form a generally triangular shaped flap which is torn open upon pulling on the projecting corner of the cloth, to permit simple and easy removal of the cloth from the bag.

11 Claims, 4 Drawing Sheets

TRANSPORTABLE FIRE EXTINGUISHING SYSTEM

TECHNICAL FIELD

The present invention relates generally to fire extinguishing materials, and more particularly to a fire retardant cloth packaged in a transportable tear away container.

BACKGROUND OF THE INVENTION

It has become common for the conventional household to purchase fire extinguishers for the kitchen, fireplace, vehicle, and other home uses. Typically these fire extinguishers include a relatively heavy bottle or the like which contains water or other fire extinguishing material. In most cases, the extinguisher is mounted on a support clip on a wall or other relatively strong support surface.

When dealing with the typical kitchen fire which arises on a stove, the use of a conventional fire extinguisher leaves extinguishing material residue spread about the stove, over the pan, or other utensil which caught fire, and typically discharges the entire fire extinguisher. Because the extinguishers must typically be mounted on a solid wall, the consumer must go to a closet or other surface typically quite a distance from the kitchen to obtain the extinguisher.

Because most extinguishers are not rechargeable (when purchased in a small size for the home), it is necessary to obtain a brand new extinguisher to replace the unit which was partially or fully discharged. The cost is relatively high, even if the fire is very small, to replace these extinguishers with any frequency. In addition, disposal of the fire extinguisher container results in the waste of a large amount of nonrecyclable material.

SUMMARY OF THE INVENTION

It is therefore a general object of the present invention to provide a lightweight, disposable, transportable fire extinguishing system which is easily mounted on a cupboard door immediately adjacent a stove or the like.

Another object of the present invention is to provide a fire extinguishing system which is very low in cost and thereby may be easily replaced at little expense.

A further object is to provide a fire extinguishing system which does not spray fire extinguishing residue throughout a large area.

Yet another object of the present invention is to provide a fire extinguishing system which is economical to manufacturer, and simple to use.

These and other objects will be apparent to those skilled in the art.

The fire extinguishing system of the present invention includes a cloth treated with fire retardant material folded and inserted within a lightweight rectangular plastic bag having adhesive strips on a rearward wall for attachment of the bag to a predetermined location. The cloth is folded such that one corner projects through an aperture in a forward wall of the bag to permit the cloth to be pulled from the bag. Perforation lines extending from the aperture towards the lower corners form a generally triangular shaped flap which is torn open upon pulling on the projecting corner of the cloth, to permit simple and easy removal of the cloth from the bag.

DESCRIPTION OF THE PREFERRED EMBODIMENT

Figure 1:
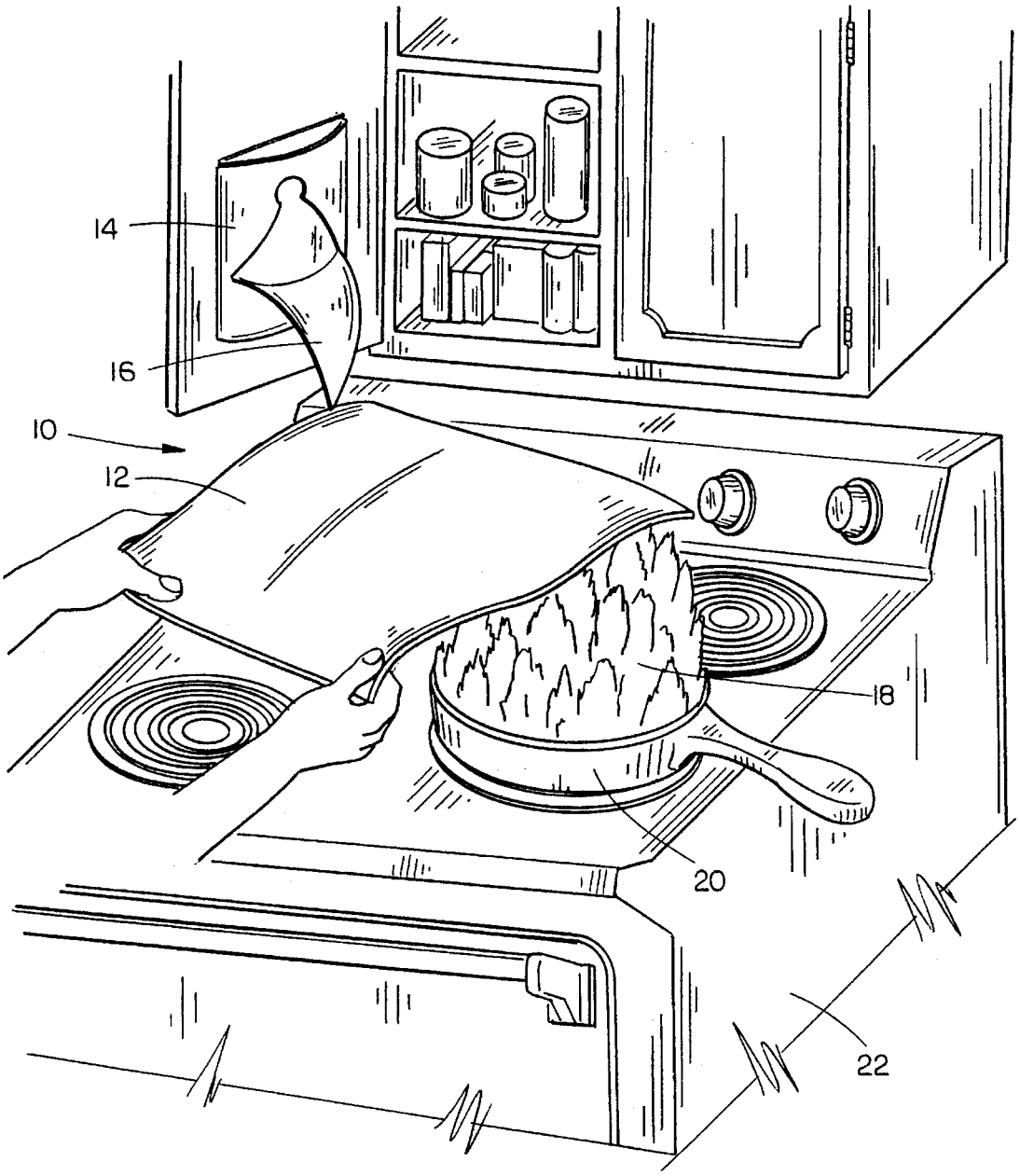
FIG. 1 is a perspective view of the fire extinguishing system of the present invention being utilized to extinguish a grease fire in a pan in the kitchen environment.
Figure 3:
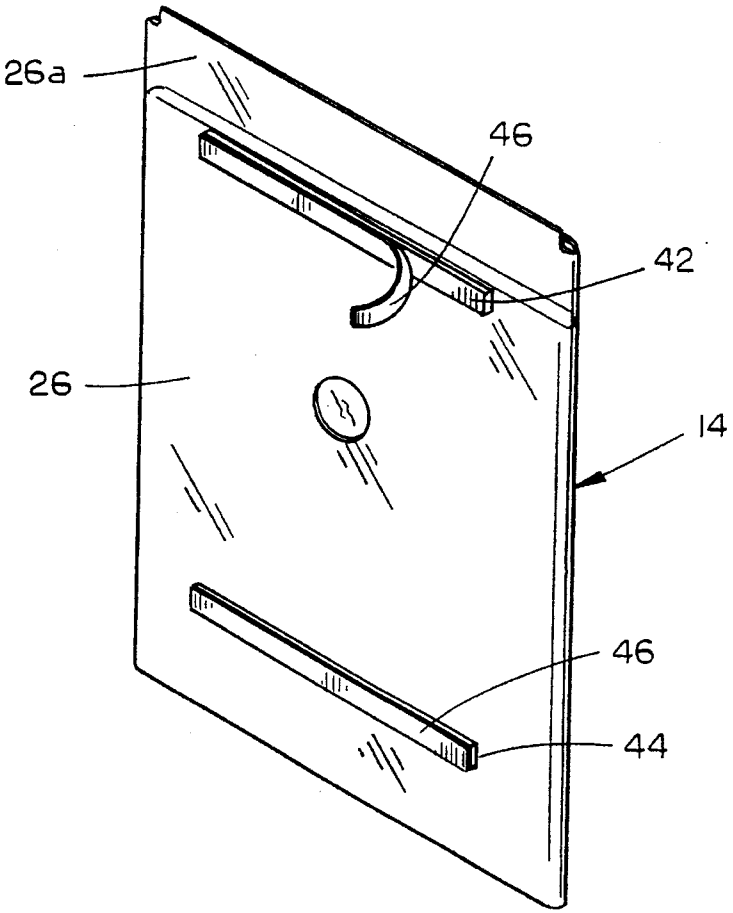
FIG. 3 is a perspective view of the rearward side of the apparatus shown in FIG. 2.

Referring now to the drawings, in which similar or corresponding parts are identified with the same reference numeral, and more particularly to FIG. 1, the fire extinguishing system of the present invention is designated generally at 10 and includes a fire retardant cloth 12 specially folded and packaged in a specially designed container 14 having a tear away front flap 16.

Cloth 12 is generally rectangular in shape and is treated with a nontoxic biodegradable fire retardant material so as to be environmentally safe. Preferably, cloth 12 has a length and width greater than the length and width of container 14, and is therefore folded for storage within container 14. Cloth 12 is designed for a single use on a small kitchen fire, such as a grease fire 18 in a pan 20 on a stove 22.

Figure 2:
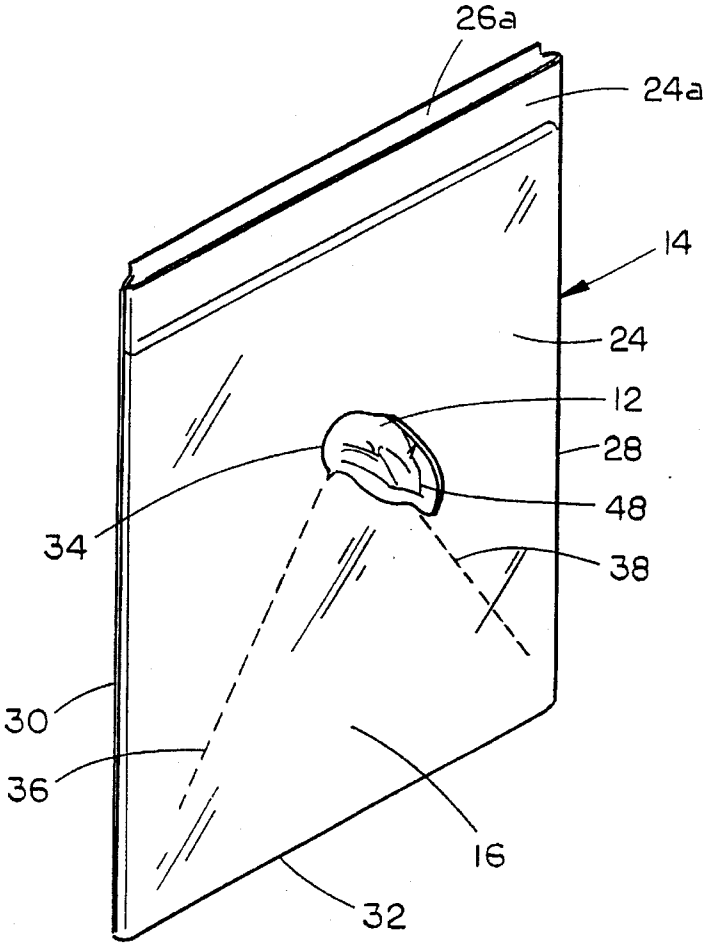
FIG. 2 is an enlarged perspective view of the fire extinguishing system of the present invention.

Referring now to FIG. 2, container 14 is preferably a lightweight rectangular shaped plastic bag having a forward wall 24 and a rearward wall 26, connected together along opposing vertical side edges 28 and 30 and a bottom edge 32. The upper edges **24*a* and 26*a* of forward and rearward walls 24 and 26 are not connected together to form an opening for inserting the cloth 12**.

An aperture 34 is formed generally centrally through the forward wall 24, through which one corner of cloth 12 protrudes to permit the cloth to be grabbed and removed from container 14. A perforation line 36 extends from aperture 34 diagonally downwardly towards the juncture of side edge 30 with bottom edge 32. A second perforation line 38 extends diagonally from aperture 34 towards the juncture of side edge 28 with bottom edge 32, thereby forming generally triangular shaped flap 16 between perforation lines 36 and 38.

The rearward surface of rearward wall 26 includes a pair of adhesive strips 42 and 44 which are affixed to the rearward surface of the rearward wall 26 in parallel spaced is apart fashion, with the adhesive side of the strips facing outwardly. A removable cover strip 46 covers the adhesive surface of strips 42 and 44 until it is desired to mount container 14 in a particular location.

Figure 5:
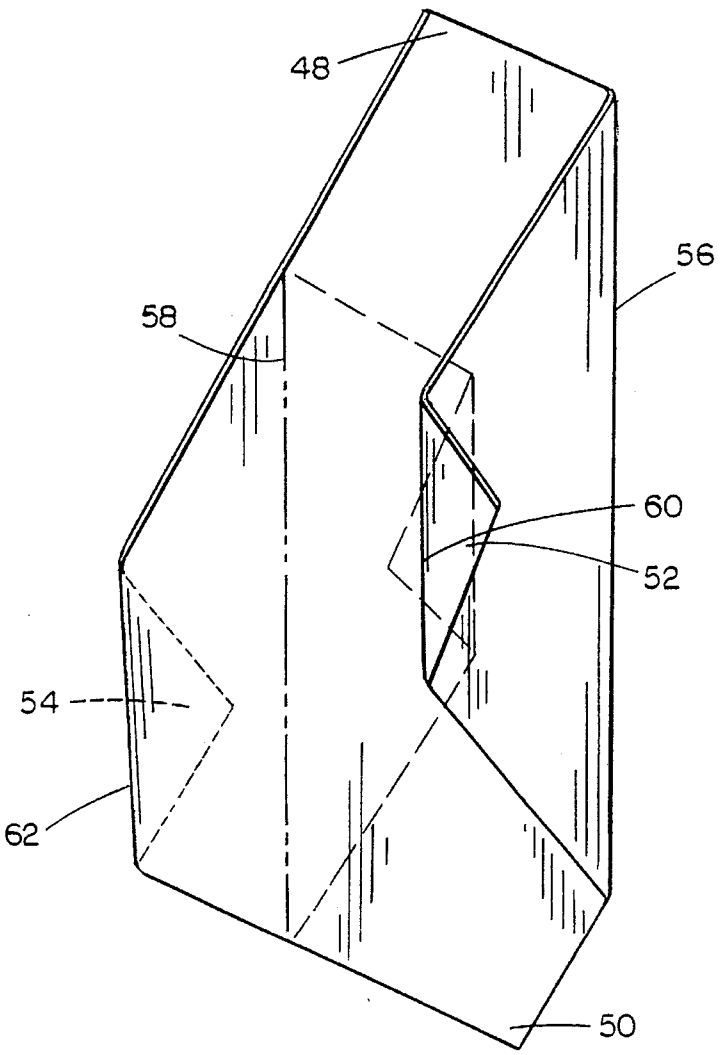
FIG. 5 is a view similar to FIG. 4 after three folds have been made in the towel.
Figure 4:
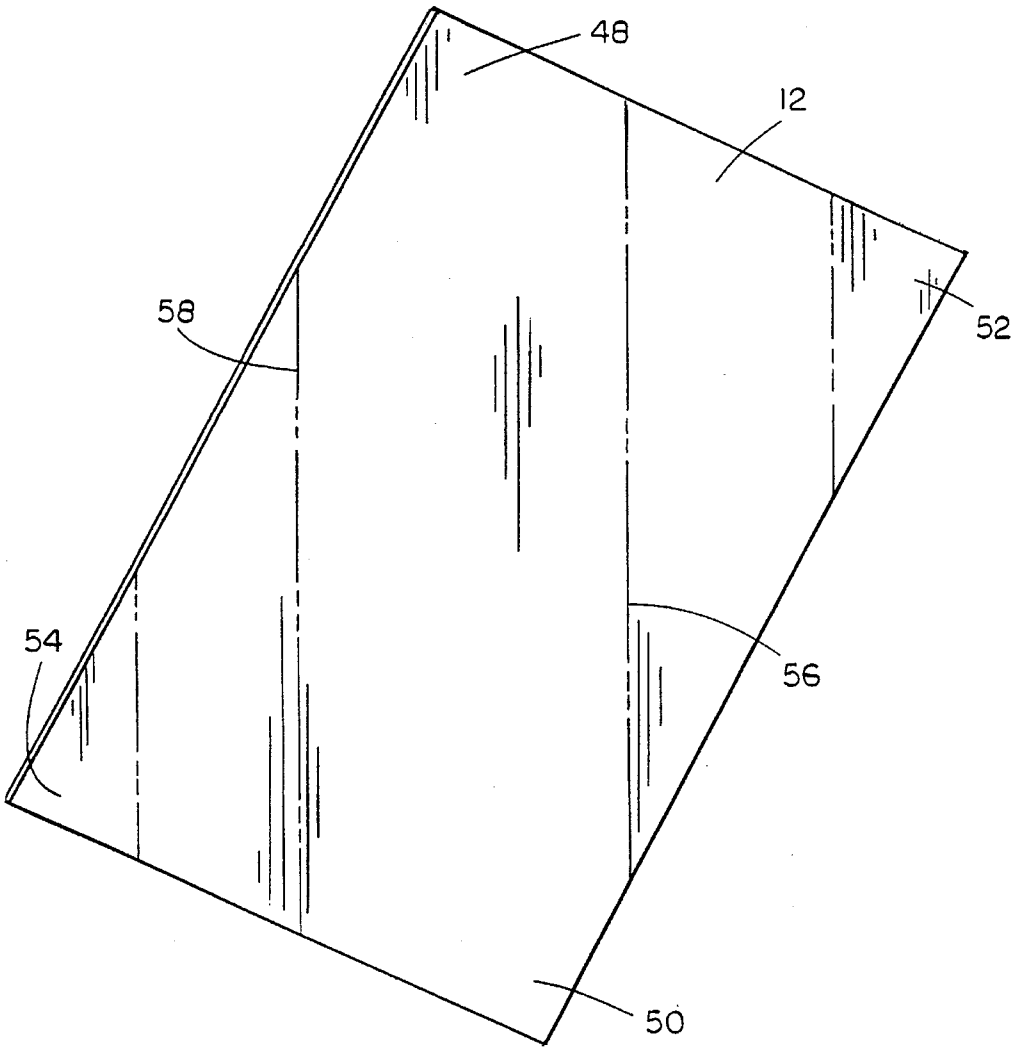
FIG. 4 is a perspective view of a fire retardant towel with broken lines showing fold lines for folding the towel for packaging.
Figure 7:
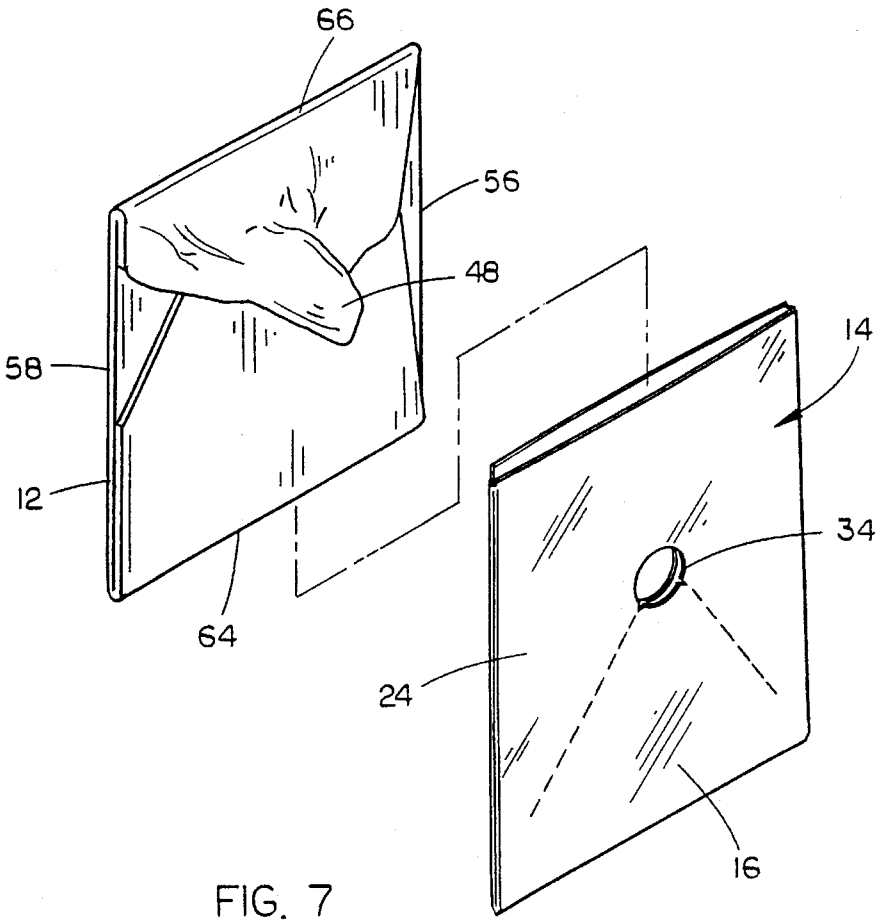
FIG. 7 is a perspective view of the completely folded towel removed from the tear away package.
Figure 6:
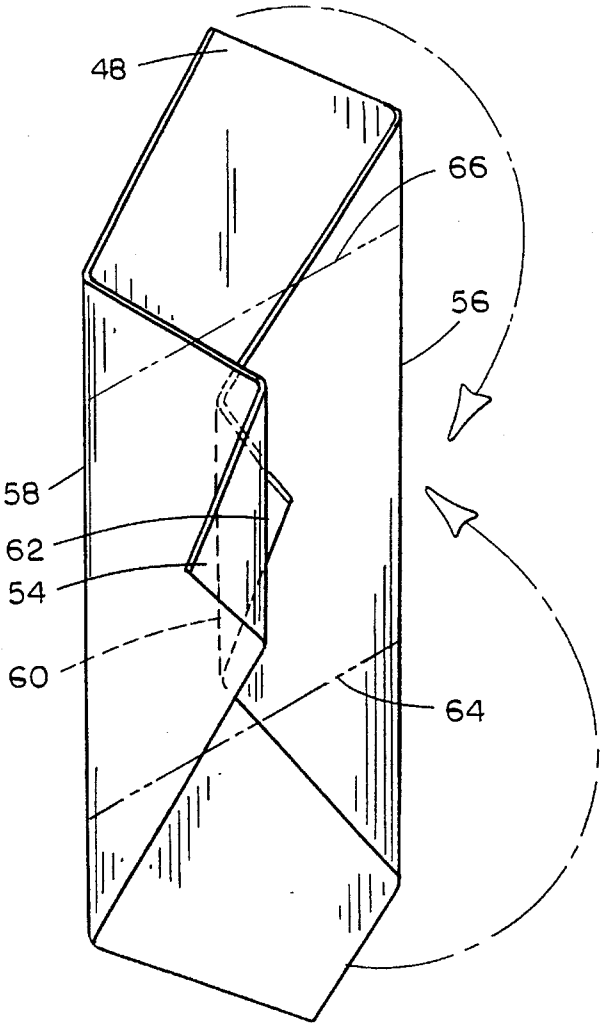
FIG. 6 is a view similar to FIG. 5 showing subsequent folds in the towel.

Referring now to FIGS. 4–7, the sequence for folding the towel is described to produce a folded cloth with a downwardly projecting corner 48 (shown in FIGS. 2 and 7) which will project through aperture 34 in forward wall 24 of container 14. As shown in FIG. 4, cloth 12 is preferably generally square with corner 48 oriented at the top, a bottom corner 50, a right corner 52, and a left corner 54. The distance between right and left corners 52 and 54 is divided into three equal areas by vertical fold lines 56 and 58. Right corner 52 is then folded over towards corner 54 until it reaches fold line 58, and then corner 52 is folded back upon itself to form a second fold 60 parallel to the first fold line 56, as shown in FIG. 5. Corner 54 is then folded over to first fold line 56 and then back upon itself to form a short fold line 62 parallel with vertical fold lines 56 and 58, as shown in FIG. 6. The distance between upper and lower corners 48 and 50 is then divided in thirds by horizontal fold lines 64 and 66. Bottom corner 50 is then folded upwardly to horizontal fold line 66, about fold line 64, and upper corner 48 is folded down to fold line 64 about upper horizontal fold line 66. Corner 48 is then pulled outwardly away from the completely folded cloth 12, as shown in FIG. 7, so as to project through aperture 34 when cloth 12 is inserted within container 14.

In operation, container 14 is preferably mounted under a cabinet or on the interior of a cabinet door, as shown in FIG. 1. Corner 48 is journaled through aperture 34 to project slightly from container 14 as shown in FIG. 2 to provide a pull tab which may be grabbed to remove cloth 12 from container 14. In the event of a stove top fire, corner 48 is gripped and pulled sharply downward which causes front flap 16 of container 14 to tear along perforation lines 36 and 38, thereby fully releasing cloth 12 from container 14. Cloth 12, with fire retardant therein, may then be immediately and conveniently thrown over the fire, depriving it of oxygen as to distinguish it. The used cloth may be simply disposed of by throwing it away.

Whereas the invention has been shown and described in connection with the preferred embodiment thereof, many modifications, substitutions, and additions may be made which are within the intended broad scope of the appended claims.

I claim:

1. A fire extinguishing system comprising:

a container; and a cloth treated with fire retardant positioned within the container;

said container including a forward wall and a rearward wall, said walls connected together along at least opposing side edges and a bottom edge to form a pocket therebetween holding said cloth;

said container forward wall having an aperture therethrough and a portion of said cloth projecting outwardly through said aperture.

2. The fire extinguishing system of claim 1, further comprising at least a first line of perforations extending from said aperture towards an edge of the forward wall, permitting tearing of the forward wall upon pulling of the projecting cloth portion.

3. The fire extinguishing system of claim 2, further comprising a second line of perforations extending from said aperture and spaced apart from the first perforation line.

4. The fire extinguishing system of claim 3, wherein said first perforation line extends towards a junction of the forward wall bottom edge and one forward wall side edge, and the second perforation line extends towards a junction of the forward wall bottom edge and a second forward wall side edge, to form a generally triangular shaped flap between the perforation lines and the forward wall bottom edge.

5. The fire extinguishing system of claim 1, wherein said container includes an opening formed between said forward and rearward walls along upper edges thereof, permitting access to an interior of said pocket.

6. The fire extinguishing system of claim 1, wherein said cloth is generally rectangular, including an upper and a lower opposing corner and a right and a left opposing corner, and wherein said upper corner of said cloth is journaled through said forward wall aperture to project from said container.

7. The fire extinguishing system of claim 6, wherein said cloth has a length and width greater than a length and width of said container, and wherein said cloth is folded to fit within said container.

8. The fire extinguishing system of claim 7, wherein said cloth is folded with said upper corner folded downwardly towards the lower corner to form an upper horizontal fold with said upper corner positioned on top of the remainder of the cloth.

9. The fire extinguishing system of claim 8, wherein:

said right corner is folded over upon the cloth towards the left corner to form a right vertical fold approximately one-third of a distance between the right and left corners;

said left corner is folded towards the right corner to form a left vertical fold approximately one-third of the distance between the left corner and the right corner;

said bottom corner is folded upwardly towards the upper corner to form a lower horizontal fold approximately one-third of a distance between the lower corner and the upper corner; and said upper horizontal fold is located approximately one-third of the distance between the upper corner and the lower corner;

said folded cloth having a length and width, as measured between the left fold, right fold, lower fold and upper fold, less than the length and width of the container, and a thickness to fit within the container pocket.

10. The fire extinguishing system of claim 1, further comprising attachment means mounted on the rearward wall of said container for attaching said container to a mounting surface.

11. The fire extinguishing system of claim 10, wherein said mounting means includes a pair of adhesive strips.

* * * * *